US005473318A

United States Patent [19]

Martel

[11] Patent Number: 5,473,318

[45] Date of Patent: Dec. 5, 1995

[54] SECURE REMOTE CONTROL SYSTEM WITH RECEIVER CONTROLLED TO ADD AND DELETE IDENTITY CODES

[75] Inventor: Brian Martel, Walled Lake, Mich.

[73] Assignee: Active Control Technology Inc., Windsor, Canada

[21] Appl. No.: 819,072

[22] Filed: Jan. 10, 1992

[51] Int. Cl.[6] ..... G08G 1/00

[52] U.S. Cl. ..... 340/825.31; 340/825.69; 340/928; 340/932.2

[58] Field of Search ..... 340/825.31, 825.34, 340/825.69, 825.72, 928, 932.2; 52/174, 175; 414/227, 232; 49/25, 29, 30, 31, 199; 318/466, 468

[56] References Cited

U.S. PATENT DOCUMENTS

| | | | |
|---|---|---|---|
| 3,575,586 | 4/1971 | Kroll | 340/932.2 |
| 3,701,100 | 10/1972 | Yarbrough . | |
| 3,953,769 | 4/1976 | Sopko . | |
| 4,006,459 | 2/1977 | Baker et al. . | |
| 4,196,347 | 4/1980 | Hadley . | |
| 4,296,404 | 10/1981 | Sheldon . | |
| 4,464,651 | 8/1984 | Duhame | 340/825.69 |
| 4,485,382 | 11/1984 | Moore | 340/825.69 |
| 4,665,395 | 5/1987 | Van Ness | 340/825.31 |
| 4,677,284 | 6/1987 | Genest | 340/825.31 |
| 4,750,118 | 7/1988 | Heitschell et al. | 340/825.69 |
| 4,811,012 | 3/1989 | Rollins | 340/825.31 |
| 4,894,654 | 1/1990 | Serenbetz | 340/825.69 |
| 5,027,553 | 7/1991 | Vergara | 49/30 |
| 5,103,221 | 4/1992 | Memmola | 340/825.1 |

*Primary Examiner*—Michael Horabik
*Attorney, Agent, or Firm*—Young, MacFarlane & Wood

[57] ABSTRACT

A door operator provides enhanced security for controlled vehicle access by employing transmitters having unique identity codes that are fixed in manufacture. A receiver includes a nonvolatile read/write identity code memory for storing the authorized identity codes. If a received identity code is found within this memory, then the user is authorized and the door is opened. Otherwise, the user is not authorized and entry is refused. A remotely disposed memory controller controls the authorized identity codes stored in the identity code memory, which is preferably electrically erasable programmable read only memory (EEPROM). The memory controller is preferably a desk top computer including a data base program with the identity of authorized users. The identity code of transmitter held by a formerly authorized used can be determined via the data base program and deleted from the identity code memory without requiring return of the transmitter. Pass back is restricted by preventing from additional door accesses for a predetermined time following each access. In an alternative embodiment a two button transmitter includes both a fixed identity code and a user selectable identity code. One button transmits the selectable identity code to individualized receiver/operators also having a user settable identity code.

9 Claims, 4 Drawing Sheets

SECURE REMOTE CONTROL SYSTEM WITH RECEIVER CONTROLLED TO ADD AND DELETE IDENTITY CODES

TECHNICAL FIELD OF THE INVENTION

The technical field of the present invention is that of secure automatic door operator systems using identity codes and especially such systems that permit changing the authorized identity codes.

BACKGROUND OF THE INVENTION

Currently there are many occasions where secure vehicle access to a location such as a parking lot or parking garage is desirable. The parking lot or garage may be associated with an office building, an apartment building, a condominium development or the like. It is known in the art to provide vehicle access via a radio frequency transmitter that transmits a signal modulated with an identity code. A receiver located within the parking lot or garage demodulates received radio frequency signals. If the receiver determines that the received identity code is an authorized identity code, a door or other access barrier is opened. This permits the vehicle to enter the controlled space. In the known art, the authorized transmitters have the same identity code or one of a limited number of identity codes. Likewise, the receiver responds to only this limited number of identity codes.

There is a problem with prior art systems. These prior art systems do not distinguish between the various transmitters. Systems of this type used with large buildings have a certain amount of turn over of clients on a regular basis. Thus there are generally several formerly authorized users who are now unauthorized. In the prior art systems such formerly authorized uses could not be easily locked out without return of the transmitter. It is impractical to reprogram the receiver and the transmitters of the still authorized users each time a former client retains possession of a transmitter. These formerly authorized users thus compromise the security of the system.

A further problem is called pass back. An authorized user may use his transmitter to enter the parking lot or garage and then retrigger the door with the transmitter. This again opens the door allowing an unauthorized entry. Prior art systems cannot prevent this unauthorized use.

There is therefore a need in the art for a more secure system for control of vehicle access to a parking lot, garage or like structure.

SUMMARY OF THE INVENTION

The present invention provides enhanced security by employing transmitters having unique identity codes that are fixed in manufacture. In the preferred embodiment, the transmitters include an application specific integrated circuit or microcontroller having a portion of read only memory specifying the identity code. This feature permits discrimination between the various transmitters.

The receiver includes a nonvolatile read/write identity code memory for storing the authorized identity codes. A transmitter is authorized for use by storing its identity code within this identity code memory. If the received identity code is found within the memory, then the user is authorized and the door is opened. Otherwise, the user is not authorized and entry is refused. A door operator moves the door between the opened and closed positions in response to signals from the receiver.

This invention includes a memory controller that controls the authorized identity codes stored in the identity code memory. In the preferred embodiment the authorized identity code memory is electrically erasable programmable read only memory (EEPROM). The memory controller is preferably disposed remotely from the receiver and coupled to the receiver via a wired link. Each transmitter preferably has its identity code or an encrypted version of its identity code imprinted on its outer case. An authorized user can be added by reading the identity code from the outer case, decrypting this if necessary, and entering it into the memory controller. Alternatively, the user enters the encrypted identity code and the memory controller decrypts it. The memory controller then signals the identity code to be added to the EEPROM via a special write cycle.

The memory controller is preferably a desk top computer. This desk top computer includes a data base program that tracks the identity of authorized users. Thus if a transmitter is not returned by a formerly authorized user, the identity code of that transmitter can be determined via the data base program. The formerly authorized user can be locked out by erasing the corresponding identity code from the authorized identity code memory without requiring return of the transmitter.

This invention includes a manner to restrict pass back. The particular identity code will be prevented from additional door accesses for a blocking interval following each access. The receiver controls the door to automatically close after each vehicle entry. The identity codes of recently used transmitters are stored within the receiver during this blocking interval. Preferably the length of this blocking interval is variable depending on the time of day. In this manner the blocking interval can be tailored to the expected traffic rate.

An alternative embodiment employs a two button transmitter. Operation of the first button transmits a predetermined unique identity code fixed in manufacture used as described above. Operation of the second button transmits a manually selectable identity code. This manually selectable identity code is used with an individual door operator under the control of the particular user which also has a manually selectable identity code. This is useful in two level security systems such as a condominium development with a parking lot access gate and individual garage doors.

BRIEF DESCRIPTION OF THE DRAWINGS

These and other objects and aspects of the present invention will become clear from the following description of the invention, in which.

DETAILED DESCRIPTION OF THE PREFERRED EMBODIMENTS

Figure 1:
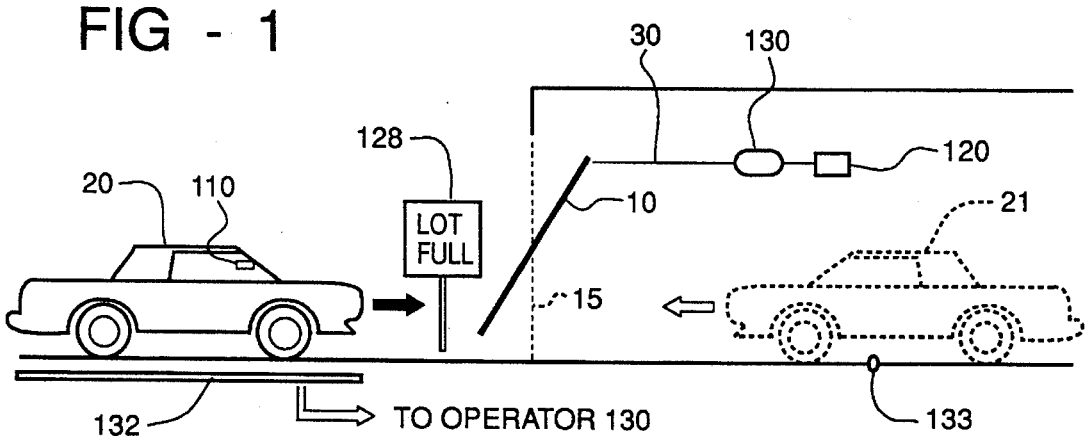
FIG. 1 illustrates the physical placement of various parts of the preferred embodiment of the present invention.

FIG. 1 illustrates the major parts of this invention in use. A door 10 in an opening 15 permits entry into and exit from a controlled space. In the typical system this controlled space is a parking lot or garage attached to an office building, apartment building, condominium development or the like. Mechanical coupling between door operator 130 and door 10 via linkage 30 permits controlled opening and closing. The present application will refer to door 10, illustrated in FIG. 1 as an overhead door. This is an example only. It should be understood that this invention is equally applicable to any type door, gate or other mechanically movable structure capable of providing controlled vehicle access.

Each authorized user of the controlled space has a transmitter 110. Transmitter 110 is generally carried in a motor vehicle 20. When the vehicle arrives to enter the controlled space, the user activates transmitter 110. As will be further described below, transmitter 110 produces a radio frequency transmission modulated width a unique identity code. Receiver 120 signals door operator 130 via relay 124 upon reception of a radio frequency signal modulated with a valid identity code. Door operator 130 opens the door in response to the closure of relay 124.

In the preferred embodiment, receiver 120 controls a lot full indicator 128. Receiver 120 maintains a lot count. Receiver 120 increments this lot count upon each vehicle entry triggered by a transmitter 110. The lot count is decremented upon each vehicle exit triggered by pneumatic tube 133. Before opening door 10, receiver 120 compares the current lot count with a predetermined number corresponding to the capacity of the parking lot or garage. If the lot count equals or exceeds the capacity, receiver 120 does not open door 10. Instead, receiver 120 activates lot full indicator 128. Lot full indicator 128 is preferably a lighted sign disposed near opening 15 to be visible by any vehicle desiring to enter the building. Lot full indicator 128 is normally turned off, but is turned on when the lot is full.

Figure 2:
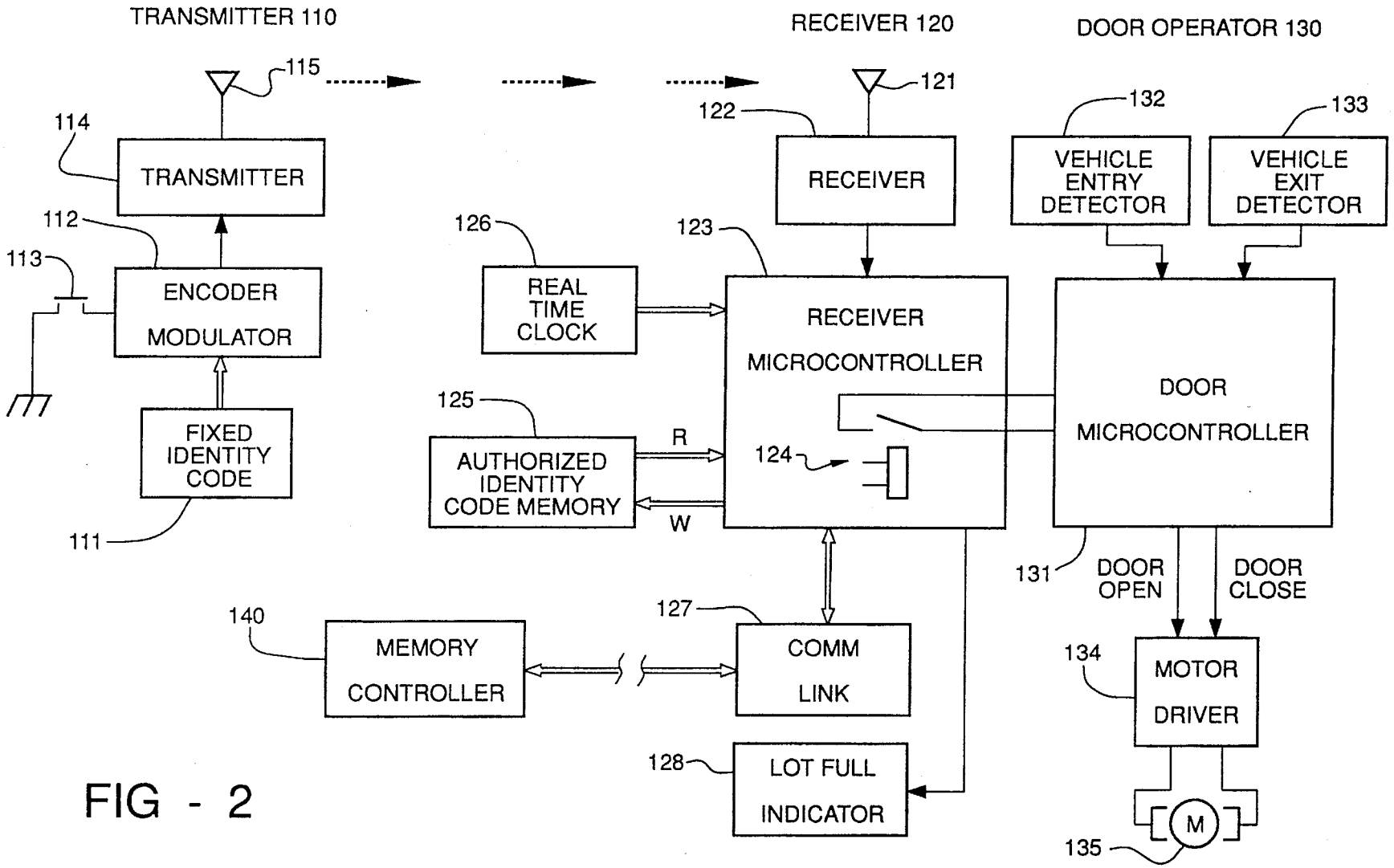
FIG. 2 illustrates in block diagram form the circuits of the transmitter and receiver/operator of the present invention.

FIG. 2 illustrates in block diagram form the major components of transmitter 110, receiver 120 and door operator 130. The typical system would include a single receiver 120 paired with a corresponding door operator 130 and a plurality of transmitters 110. FIG. 2 illustrates a single transmitter 110 for the sake of brevity.

Transmitter 110 includes a fixed identity code unit 111, an encoder/modulator 112, a momentary contact push button switch 113, a radio frequency transmitter 114 and an antenna 115. The user activates transmitter 110 by operation of push button switch 113. Encoder/modulator 112 reads the identity code set by fixed identity code unit 111 upon operation of push button switch 113. Encoder/modulator 112 then activates transmitter 114 to produce a radio frequency signal on a fixed frequency. Encoder/modulator 112 further modulates the transmission of transmitter 114 with the identity code. Transmitter 114 radiates this modulated radio frequency signal via antenna 115.

In accordance with the present invention, the identity code of each transmitter 110 is fixed upon manufacture. In the preferred embodiment fixed identity code unit 111 and encoder/modulator 112 are realized by a single application specific integrated circuit. Alternatively, fixed identify code unit 111 and encoder/modulator 112 may be embodied in a microcontroller. Fixed identity code unit 112 may then be formed as read only memory whose data is determined by a mask step in the construction of the application specific integrated circuit or microcontroller. Each such circuit is given a unique identity code embodied in read only memory. In the preferred embodiment the identity code is 24 bits in length, thereby providing more than sixteen million possible identity codes. It is important that the identity code of each transmitter unit be unalterable by the user. The construction technique described above provides this feature. Radio frequency transmitter 114 is preferably formed of separate semiconductor components.

Receiver 120 responds to radio frequency signals received from a transmitter 110. Radio frequency signals received by antenna 121 are coupled to receiver 122. The received signal is supplied to receiver microcontroller 123. Receiver microcontroller 123 demodulates any identity code modulated on the received radio frequency signal. Authorized identity code memory 125, which is connected to receiver microcontroller 123, stores indications of which of the $2^{24}$ possible identity codes are authorized to operate door 10. Receiver microcontroller 123 also receives a real time signal real time clock 126. In response to these inputs and with the identity codes stored in authorized identity code memory 125, receiver microcontroller 123 operates relay 124 and lot full indicator 129. Certain processes of receiver 120 are time related. The time indicated by real time clock 126 controls these processes. Receiver microcontroller 123 is preferably embodied in a microprocessor circuit having read/write random access memory and a control program fixed in read only memory. The control program will be more fully described below in conjunction with FIG. 5.

In the preferred embodiment, authorized identity code memory 125 consists of electrically erasable programmable read only memory (EEPROM). Electrically erasable programmable read only memory is nonvolatile, it retains its contents upon loss of electrical power. Electrically erasable programmable read only memory easily read out in the same manner as reading from random access read/write memory (RAM) and read only memory (ROM). Data may also be written into electrically erasable programmable read only memory via a write operation. It is known in the art that electrically erasable programmable read only memories are capable of only a limited number of such write operations for each memory location.

Memory controller 140 is preferably coupled to receiver microcontroller 123 via communications link 127. In the preferred embodiment communications link 127 uses either the RS422 or the RS485 communication protocol. Receiver microcontroller 123 has the capacity to directly perform the write operation required to enter data into authorized identity code memory 125. The particular identity code written into authorized identity code memory 125 is specified by signals from memory controller 140. Although FIG. 2 illustrates memory controller 140 as indirectly connected to authorized identity code memory 125 via receiver microcontroller 123, those skilled in the art would realize that memory controller 140.may be directly connected to authorized identity code memory 125. In that case, memory controller 140 must be capable of generating the signals required for the write operation.

Memory controller 140 controls which of the $2^{24}$ possible identity codes are authorized by controlling the data stored in authorized identify code memory 125. It is anticipated that a capacity of 2K bytes, permitting the storage of more than five hundred 24 bit identity codes, is adequate for most uses. Accommodation of a greater or lesser number of identity codes may be selected by selection of the size of authorized identity code memory 125.

Memory controller 140 is preferably a desk top personal computer. As such, memory controller 140 preferably includes a data base management program for tracking the identity code of the transmitter assigned to each authorized user. Preferably each transmitter 110 has either its unique identity code or a minimally encrypted version of its unique identity code imprinted on its outer housing. Entry of a newly authorized transmitter identity code requires specification of this identity code at memory controller. This can be achieved by reading the identity code or the encrypted identity code from the outer housing of the transmitter and entering this at memory controller 140. Memory controller 140 may include the capacity to decrypt encrypted identity codes. Memory controller 140 then signals receiver microcontroller 123 to write the appropriate identity code within authorized identity code memory 125 using the special write operation. Memory controller 140 preferably also indicates the specific address for this write operation. At the same time, data identifying the user of that transmitter is entered in the data base.

Deletion of a previously authorized transmitter identity code takes place by writing over the deleted identity code. This overwritten identity code should be a predetermined identity code, such as all "0", which is never an authorized identity code and that never appears in any transmitter. Resort to the data base within memory controller would permit deletion of the identity code issued to a particular user without requiring the presence of the transmitter. Thus the access of a formerly authorized user can be blocked without needing to recall the transmitter. Note that because the identity code of each transmitter 110 cannot be changed, there is no possibility of using transmitter 110 with a "stolen" authorized identity code. Memory controller 140 preferably retains the data about the user of a deleted transmitter until the transmitter is returned.

Specification of the write address permits memory controller 140 to permit fastest operation of receiver microcontroller 123. One of the tasks of receiver microcontroller 123 is to determine if any identity code stored within authorized identity code memory 125 matches the recently received identity code. The fastest manner to perform this task requires the identity codes to be stored in numerical order. Preserving this numerical order when identity codes are added and deleted requires rewriting much of the memory. Such rewriting within authorized identity code memory 125 need not be done in order to preserve the limited number of write operations of the electrically erasable programmable read only memory. Instead memory controller should write newly authorized identity codes to reuse the memory locations of deleted formerly authorized identity codes. This would tend to keep the authorized identity code files in a mostly contiguous segment of memory, thus speeding up the checking of all the authorized identity codes. A microcontroller of the computational capability contemplated in this application would be capable of making about 1000 such tests in 0.1 second. This speed should be adequate for most systems because it is a fraction of the time required to open the door.

Memory controller 140 is preferably disposed remotely from receiver 120. In a typical installation, receiver 120 is disposed near door 10 in the manner illustrated in FIG. 1. Memory controller 140 is preferably located within a rental office or the like. In the case in which memory controller 140 is embodied in a desk top personal computer, a RS422 or RS485 communications transceiver can be formed on a plug-in circuit board within the computer. Alternately, a small circuit box can be provided to convert the more commonly provided RS232 protocol to the selected protocol. The RS422 or RS485 protocol is preferred for the link between memory controller 140 and receiver 120 because these signals can be carried via a twisted pair over longer distances than the more commonly provided RS232 protocol. Thus the addition and deletion of the identity code of a transmitter can take place where the corresponding records are kept.

Other types of communication links between receiver microcontroller 121 and memory controller 140 are possible. A particularly attractive alternative involves use of the telephone system. Both receiver microcontroller 121 and memory controller 140 would include a modem selectively connectable to the telephone system. For security purposes a call back system is preferred. Memory controller 140 would dial the telephone line connected to receiver microcontroller 121, transmit a code and then hang up. Receiver microcontroller 121 would check this code against an internally stored code. If these match, then receiver microcontroller 121 would dial the fixed telephone number connected to memory controller 140. This telephone number is stored within a nonvolatile memory coupled to receiver microcontroller 121. This could be authorized identity code memory 125. These circuits would then exchange data in the manner previously described. This call back system is more secure because receiver microcontroller 121 will only interact with the system responding to the telephone number stored in its memory. With such a system, a single centrally located memory controller 140 could service the memory control needs of a plurality of receiver 120's.

It should be understood that memory controller 140 is not necessary for the ordinary operation of receiver 120. Receiver 120 can perform all its functions independently of memory controller 140, except for the changing of authorized identity codes. Thus most operations do not require memory controller 140. Thus memory controller 140 may be turned off or disconnected during normal operations.

Door operator 130 controls the closing of door 10. Induction loop 132, buried in the paving in the path of an entering vehicle, detects the presence of vehicle 20. Typically vehicle 20 will approach door 10, stop at the location of induction loop 132 and then activate transmitter 110. In any event, a vehicle must pass induction loop 132 when entering the building. Vehicle 20 enters the building after door 10 opens. Door microcontroller 131 receives a signal from induction loop 132. Upon each opening of door 10 for entry, door microcontroller 131 determines when vehicle 20 leaves the vicinity of induction loop 132. Door microcontroller 131 closes door 10 a predetermined time following entry by vehicle 20. This predetermined time is selected long enough to permit a single vehicle to enter the controlled space without problem, but short enough to prevent entry of a second vehicle.

Door microcontroller 131 also controls the opening and closing of door 10 for exit from the building. A pneumatic tube 133 is disposed on the vehicle path for exiting the building. When pneumatic tube 133 is tripped, indicating the presence of vehicle 21 (shown in FIG. 1 in dashed lines) desiring to exit, door microcontroller 131 opens door 10. Door operator 130 then closes door 10 a predetermined time after pneumatic tube 133 is tripped. In a manner similar to the case of building entry, this predetermined time is selected long enough to permit a single vehicle to exit, but short enough to discourage unauthorized entry of another vehicle.

Figure 3:
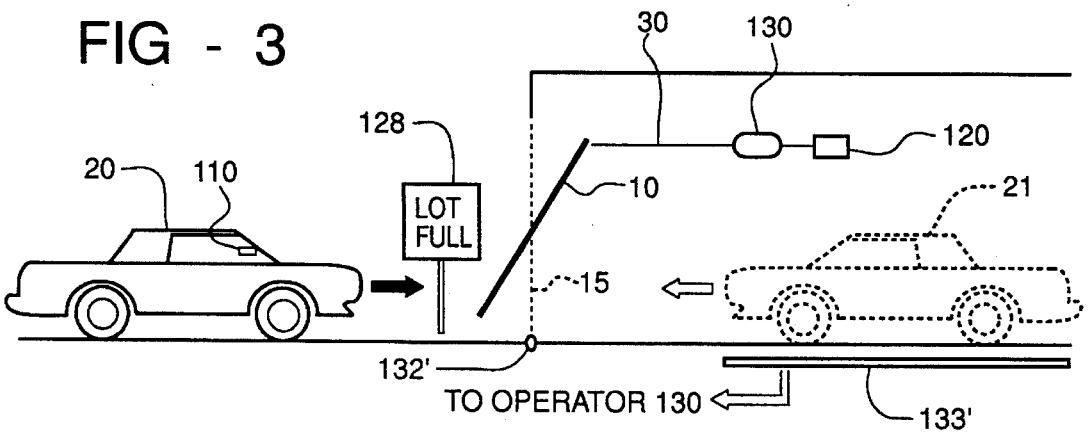
FIG. 3 illustrates the physical placement of various parts of an alternative embodiment of the present invention.
Figure 4:
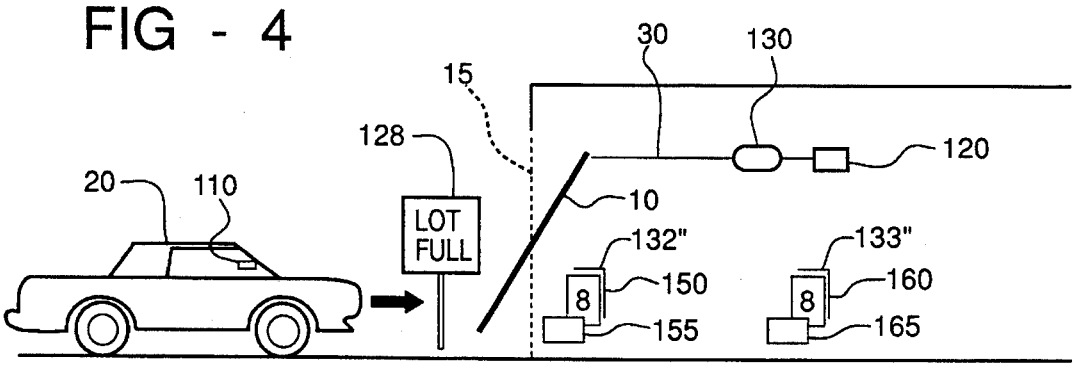
FIG. 4 illustrates the physical placement of various parts of a further alternative embodiment of the present invention.

FIGS. 3 and 4 illustrate examples of alternative vehicle entry and exit detectors that can be used with this invention. FIG. 3 illustrates pneumatic tube 132' employed as a vehicle entry detector. Activation of pneumatic tube 132' after a transmitter has opened door 10, indicates that the vehicle has entered. FIG. 3 also shows induction loop 133' as the vehicle exit detector. Detection of a vehicle by induction loop 133' causes door microcontroller 131 to open door 10 in the same manner as previously described in conjunction with pneumatic tube 132 illustrated in FIG. 1. FIG. 4 illustrates vehicle entry detector 132" consists of photoelectric transmitter/receiver 150 and reflector 155. Photoelectric transmitter/receiver 150 transmits a light beam across opening 15, where it is reflected by reflector 155 back to photoelectric transmitter/receiver 150. Interruption of the reflected beam after opening door 10 in response to a properly encoded radio frequency signal indicates entry of vehicle 20. Likewise, FIG. 4 illustrates vehicle exit detector 133" as photoelectric transmitter/receiver 160 and reflector 165. Interruption of this beam indicates a vehicle desires to exit via door 10. Those skilled in the art would realize that these detectors represent mere examples of the type of vehicle entry and exit detectors that can be used with this invention.

The above detailed division between receiver 120 and door controller 130 represents merely a convenient design choice. This embodiment of the invention relies on the fact that an existing design for door operator 130 could be with the above described receiver 120. This design required less work to realize than a completely new design. In addition, this design permits retrofit of the invention into existing door control installations without replacing the entire door controller system by substitution of the receiver described above for the prior receiver.

Those skilled in the art would realize that it is equally feasible to embody this invention in a single microcontroller. It that case this single microcontroller would be coupled to receiver, 122, authorized identity code memory 124, real time clock 126, communications link 127, lot full indicator 128, vehicle entry detector 132, vehicle exit detector 133 and motor controller 134. This single microcontroller would perform all the functions of the apparatus as described below in conjunction with FIG. 5.

Figure 5:
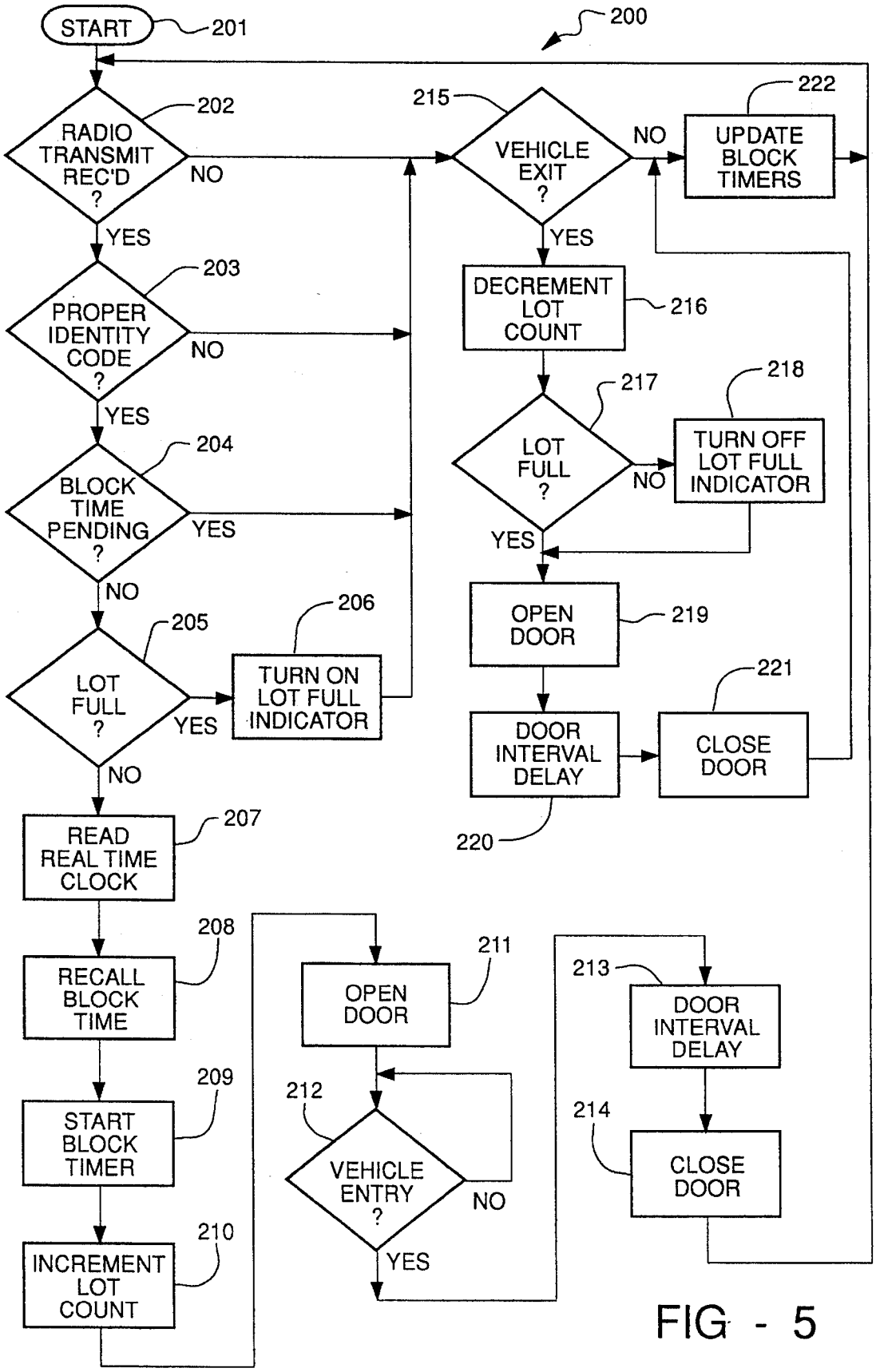
FIG. 5 illustrates in flow chart form the operation of the receiver/operator of the present invention.

Further details of the operation of receiver 120 and door controller 130 are illustrated in FIG. 5. FIG. 5 is a flow chart of the control program permanently stored in the read only memories of receiver microcontroller 123 and door microcontroller 131. Program 200 illustrated in FIG. 5 is not intended to show the exact details of this control program. Instead, program 200 is intended to illustrate only the general steps employed in this program for practicing this invention. Some conventional features are omitted from program 200. In particular, it is well known to provide an automatic stop of door 10 upon reaching either the fully opened or fully closed positions. In addition, some form of obstruction detection that stops or reverses door movement is commonly used in these systems. These and other conventional features are not illustrated because they form no part of this invention. Those skilled in the art of microprocessor programming would be enabled to provide the exact details of the control program from program 200 illustrated here and the other descriptions of the present application once the selection of the microprocessor unit to embody the invention is made. Note that FIG. 5 illustrates some functions performed by receiver microcontroller 121 and some functions performed by door microcontroller 131. Thus FIG. 5 assumes proper communication between these microcontrollers or their embodiment in a single programmed device.

FIG. 5 illustrates program 200 in flow chart form. Program 200 begins at start block 201. Start block 201 corresponds to all the initialization steps executed upon initial application of electric power to the apparatus. These initialization steps typically include a self-test, followed by setting various memory registers and latches to known states. These steps are known in the art and will not be further described.

Program 200 next enters a test loop. The first test is for the receipt of an encoded radio frequency transmission (decision block 202). If an encoded radio frequency transmission is received, program 200 tests to determine if the identity code is an authorized identity code (decision block 203). If the received identity code is not authorized, then program 200 proceeds to the next test in the test loop, which will be further described below.

Program 200 next tests to determine if any block time is pending for the recently received identity code (decision block 204). The preferred embodiment of this invention prevents a transmitter from again opening door 10 for a predetermined time following each such opening. If a block time is pending, then program 200 skips the steps for opening door 10 and goes to the next test in the test loop without opening door 10. Only if no block time is pending does program 200 proceeds with the steps for opening door 10.

This provision of decision block 204 serves to prevent an authorized user from again opening the door after entering to permit an unauthorized vehicle to enter. This unauthorized practice is called pass back. By preventing immediate re-opening of door 10, pass back is severely restricted. Note that this process prevents re-opening only by recently used transmitters. Other transmitters, which have identity codes that have not been used recently, are still permitted to open door 10. The manner of determining the blocking time and its implementation will be further described below.

Program 200 next tests to determine if the parking lot is full (decision block 205). As previously described, the apparatus keeps a lot count. This lot count is incremented when door 10 is opened to let a vehicle enter and decremented when door 10 is opened to let a vehicle exit. If the lot count equals or exceeds a predetermined number corresponding to the capacity of the parking lot, then the lot is full. In this event, the lot full indicator is turned on (processing block 206) and program 200 proceeds to the next test in the test loop without opening the door.

Program 200 proceeds with operation of door 10 if the lot is not full. First, the apparatus reads the current time provided by real time clock 126 (processing block 207). The current time is used in selection of the length of the blocking time (processing block 208). A shorter blocking time is selected during times when the expected traffic is heaviest. Thus, as an example, a blocking time of one minute may be selected following each entry during morning and evening rush hours. A longer period, such as 5 minutes, may be selected during other periods of the day. A blocking period of 10 minutes may be selected during nights and other off hours. The times of day and their corresponding blocking times are preferably stored in read only memory for recall upon each opening of door 10 for entry. Upon recall of the appropriate block time, program 200 starts a block timer for the particular identity code (processing block 209). The apparatus preferably stores the identity codes subject to blocking together with their corresponding expiration times in a table within random access memory. The amount of memory allocated for this table depends upon the size of the parking lot and its expected traffic rate. The blocking period is shorter for peak traffic times because the higher traffic rate means that the shorter wait before re-entry produces about the same number authorized users. The applicant believes that the possibility that authorized users will be backed up behind an unauthorized user waiting for the blocking time to expire for unauthorized pass back entry will deter pass back.

After setting the block timer, program 200 increments the lot count (processing block 210). The apparatus stores the lot count in random access memory. This lot count indicates the number of vehicles inside the parking lot. One is added to this lot count each time door 10 is opened for vehicle entry.

Program 200 then controls door 10. First, the apparatus sends the door open signal to motor controller 134 for opening the door (processing block 211). Program 200 next tests to determine if a vehicle has entered (decision block 212). Vehicle entry is detected by vehicle entry detector 132. If no vehicle entry is detected, this test is repeated. After vehicle entry is detected, program 200 waits for a predetermined door interval delay (processing block 213). Program 200 measures this delay with relation to the time indicated by real time clock 126. As previously states this delay is selected to permit entry by only a single vehicle. After expiration of this delay, door microcontroller 131 sends the door close signal to motor controller 134 for closing the door (processing block 214). Thereafter program 200 returns to decision block 202 to repeat the test loop.

In the next step in the test loop, program 200 tests to determine if a vehicle is in position for exit (decision block 215). Program 200 reaches this step if no radio frequency signal is received, if a received radio frequency signal is modulated with an unauthorized identity code, if a block time is pending for an authorized received identity code, or if the lot is full. Vehicle exit detector 132 determines if a vehicle is ready for exit. If this is the case, then microcontroller 123 decrements the lot count. This subtracts one from the lot count when a vehicle leaves the parking lot. If the lot count is less than the lot capacity (decision block 217), then microcontroller 123 turns off the lot full indicator (processing block 218). In either event door microcontroller 131 sends the door open signal to motor controller 134 for opening the door (processing block 219). After a predetermined door interval delay (processing block 220) selected to permit a single vehicle to exit but not allow another vehicle to enter, door microcontroller 131 sends the door close signal to motor controller 134 for closing the door (processing block 221). Thereafter program 200 goes the next step in the test loop.

In the case in which no vehicle exit is detected, or if a vehicle exit is serviced, the program 200 updates the block timers (processing block 221). This preferably takes place with reference to the table of recently used identity codes and their corresponding expiration times. Receiver microcontroller 123 determines if any block time has expired. If this is the case, then the identity code and its corresponding expiration time are removed from the table. This frees memory space for other table entries. Upon completion of this update, program 200 returns to decision block 202 to repeat the test loop.

Figure 6:
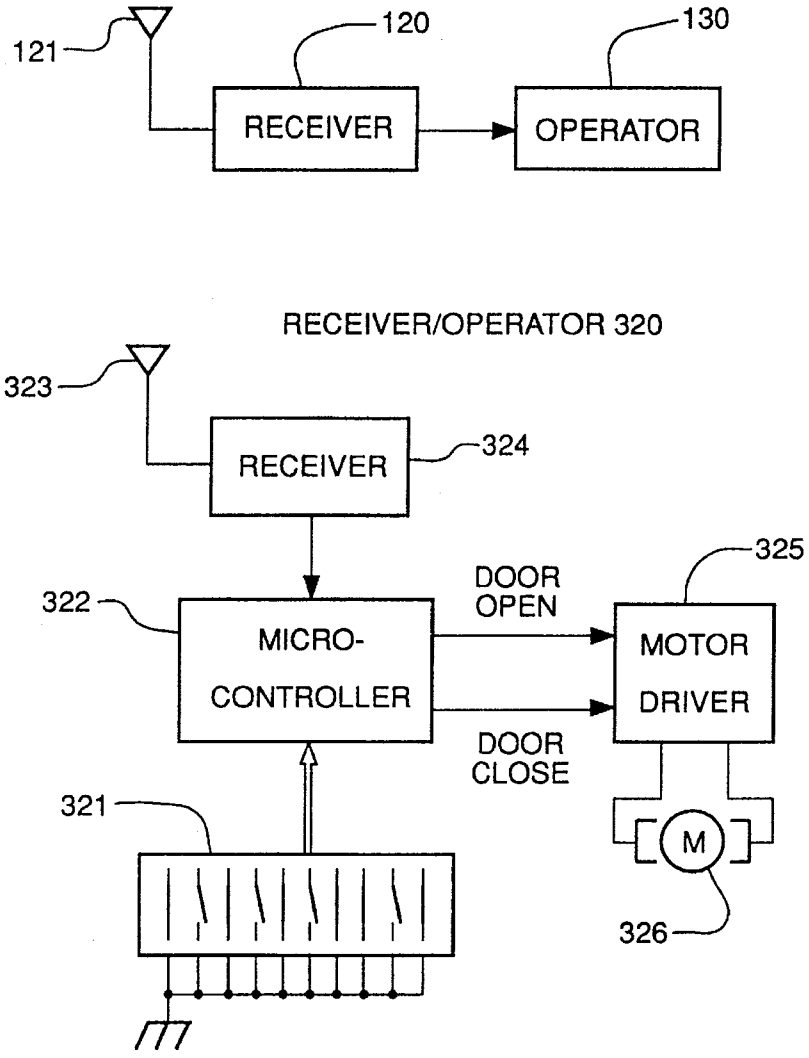
FIG. 6 illustrates an alternative embodiment of the present invention using a two button portable transmitter in a two level security system.
Figure 6:
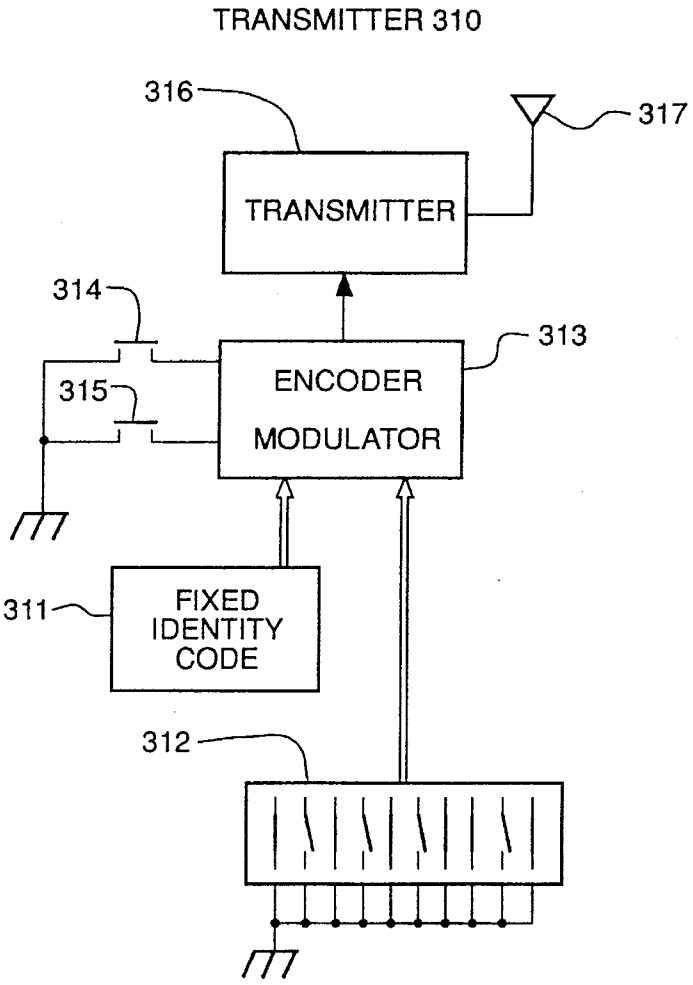

FIG. 6 illustrates an alternative embodiment of the present invention. This alternative embodiment is useful in two stage security systems. Such two stage security systems may include, for example, a condominium development with a common entry gate and individually controlled garage doors. This two stage security system would include a single paired receiver 120 and door operator 130 at the common gate, a receiver/operator 320 at each of the individually controlled garage doors and at least one transmitter 310 for each receiver/operator 320. Only a single transmitter 310 and a single receiver/operator 320 are illustrated for the sake of brevity.

In this alternative embodiment the portable transmitter unit 310 includes two push buttons 314 and 315 for transmitting two separate identity codes. Operation of push button 314 causes encoder/modulator 313 to recall the fixed identity code stored within fixed identity code unit 311. Fixed identity code unit 311 is constructed in the same manner as fixed identity code unit 111 previously described. Encoder/modulator 313 modulates the radio frequency signal produced by transmitter 316 with this fixed identity code and the resultant modulated radio frequency signal is radiated via antenna 317. This operates receiver 120 and door operator 130 in the manner described above. Note that this includes the provision of adding or deleting an identity code at receiver 120 and the anti-pass back provisions. In the example of the condominium development, receiver 120 and door operator 130 control the operation of an access gate into the condominium parking lot.

Transmitter 310 also includes an identity code setting device 312 that is manually settable by the user. According to the known art, identity code setting device 312 is a set of manually operable switches. Each switch has two positions for selection of a digital "1" or "0" for the corresponding bit of the identity code. It is known in the art to provide the set of switches in a dual in line package. This package is of the same type used to house integrated circuits and is readily mounted on a printed circuit board. It is also known in the art to provide such a identity code setting device with 10 switches permitting the setting of one of $2^{10}$ or 1024 possible identity codes.

Upon operation of push button switch 315, encoder/modulator 313 reads the switch setting of identity code setting device 312. Encoder/modulator 313 then enables transmitter 316. At the same time, encoder/modulator 313 modulates the radio frequency signal generated by transmitter 316 with the identity code read from identity code setting device 312. Thus transmitter 316 transmits a radio frequency signal via antenna 317 modulated with the identity code corresponding to the setting of identity code setting device 312.

Receiver/operator 320 is responsive to radio frequency signals for control of door operation. In the example of the condominium development receiver/operator 320 controls a garage door of an individual condominium. Antenna 323 and receiver 324 receive radio frequency signals such as transmitted by transmitter 310. Demodulator/decoder 322 demodulates any identity code modulated on this received radio frequency signal. Demodulator/decoder 322 also determines if the demodulated identity code matches the identity code set by identity code setting device 321. Identity code setting device 321 is preferably a set of switches disposed in a dual in line package of the same type as identity code setting device 312. Demodulator/decoder 322 supplies operating signals to motor controller 325 only if the identity code modulated on the received radio frequency signal coincides with the identity code set by identity code setting device 321.

Motor controller 325 supplies corresponding operating power to motor 326 for opening and closing the garage door when triggered by demodulator/decoder 322. Motor 326 is mechanically coupled to the door in a manner known in the art. It is known in the art to operate the door in a circular four phase sequence to 1) open the door, 2) stop, 3) close the door, and 4) stop upon each receipt of a properly encoded radio frequency signal. It is also known in the art to provide stops to end motor operation upon reaching the fully closed and the fully opened positions. These features of the system are conventional forming no part of the invention and thus will not be further described.

Transmitter 310 may be constructed in generally the same manner as transmitter 110. In particular, fixed identity code device 311 and encoder/modulator 313 may be embodied in a single application specific integrated circuit or programmed microcontroller circuit. Transmitter 310 is preferably formed of separate semiconductor components. It is preferable that transmitter 310 operate on the same frequency regardless of which push button is operated. The modulation techniques used for the two identity codes should differ so that a portion of a fixed identity code cannot match a user set identity code in a receiver/operator 320 and improperly operate the corresponding garage door.

The multilevel security system illustrated in FIG. 6 operates as follows. For entry the user operates push button 314 causing transmitter 310 to transmit a radio frequency signal modulated with the identity code of fixed identity code unit 311. Receiver 120 and door operator 130 open a gate permitting entry into the condominium development parking lot if the just transmitted identity code is an authorized identity code. The user then drives to his garage door and operates push button 315. In response transmitter 310 transmits a radio frequency signal modulated by the identity code set by identity code setting device 312. Receiver/operator 320 opens the garage door if this transmitted identity code matches the identity code set by identity code setting device 321. For exit, the user operates push button 315 upon clearing the garage causing receiver/operator 320 to close the garage door. Vehicle exit detector 133 causes the gate to open permitting the vehicle to exit the condominium development.

The two level security system permits differing authorities to control access at the two levels. At the first level, the condominium management controls access to the condominium parking lot via the authorized identity codes stored in authorized identity code memory 124. Access to the individual garages is under control of the user through the identity code setting devices 312 and 321. Provision of identity code setting devices 312 and 321 as manually operable switches permits each user to control the identity code used for his garage door. The user may at any time select an arbitrary one of the 1024 feasible identity codes by changing the switches in identity code setting devices 312 and 321. It is contemplated that some users may not have garages. These users would employ a single button transmitter such as transmitter 110 illustrated in FIG. 1 instead of the two button transmitter 310 illustrated in FIG. 6.

Those skilled in the art would realize that the condominium development example discussed above is merely a convenient example and the this alternative embodiment can be used in other two level security systems.

I claim:

1. An automatic door receiver system for use with a door in an opening to a limited access parking space having an opened and a closed position, said automatic door receiver system comprising a receiver unit for receiving radio frequency signals;

a nonvolatile read/write identity code memory having stored therein a plurality of authorized identity codes;

a receiver controller connected to said receiver unit and said read/write identity code memory for demodulating any identity code modulated on said radio frequency signals, and generating an open door signal whenever a demodulated identity code corresponds to an authorized identity code; and a memory controller connected to said read/write identity code memory for control of said authorized identity codes stored in said read/write identity code memory, and having means for writing identity codes into selected memory locations and for deleting identity codes by overwriting the corresponding memory location with a predetermined unauthorized identity code.

2. The automatic door receiver system as claimed in claim 1, further comprising:

a plurality of portable transmitter units, each having a predetermined unique identity code fixed in manufacture, for transmitting a radio frequency signal modulated with said unique identity code upon manual actuation; and a legible indicia imprinted on each transmitter unit, the indicia being related to the identity code.

3. An automatic door receiver system for use with a door in an opening to a limited access parking space having an opened and a closed position, said automatic door receiver system comprising a receiver unit for receiving radio frequency signals;

a nonvolatile read/write identity code memory having stored therein a plurality of authorized identity codes;

a receiver controller connected to said receiver unit and said read/write identity code memory for demodulating any identity code modulated on said radio frequency signals, and generating an open door signal whenever a demodulated identity code corresponds to an authorized identity code;

a door controller connected to said receiver controller for moving the door from the closed position to the opened position upon receipt of said open door signal;

said door controller moves the door from the opened position to the closed position a predetermined time following each movement of the door from the closed position to the opened position;

the receiver controller further inhibiting moving the door from the closed position to the opened position upon receipt of a demodulated identity code corresponding to an authorized identity code within a predetermined interval after receipt of that same demodulated identity code; and a vehicle exit detecting means disposed in vicinity of the door interior of the opening for detecting a vehicle immediately interior of the opening;

wherein said door controller is further connected to said vehicle exit detecting means for moving the door from the closed position to the opened position upon each detection of a vehicle immediately interior of the opening.

4. The automatic door receiver system as claimed in claim 3, wherein:

said vehicle exit detecting means includes a pneumatic tube disposed proximate the door interior of the opening for detection of compression of said pneumatic tube indicating presence of a vehicle immediately interior of the opening; and said door controller moves the door from the closed position to the opened position upon each detection of the presence of a vehicle immediately interior of the opening by said pneumatic tube.

5. The automatic door receiver system as claimed in claim 3, wherein:

said vehicle exit detecting means includes an induction loop disposed for detection of a vehicle immediately interior of the opening; and said door controller moves the door from the closed position to the opened position upon each detection of a vehicle immediately interior of the opening by said induction loop.

6. The automatic door receiver system as claimed in claim 3, wherein:

said vehicle exit detecting means includes a radiant beam detector projecting a radiant beam across the position of a vehicle disposed proximate the door interior of the opening for detection of interruption of said radiant beam indicating presence of a vehicle immediately interior of the opening; and said door controller moves the door from the closed position to the opened position upon each detection of a vehicle immediately interior of the opening by said radiant beam detector.

7. The automatic door receiver system as claimed in claim 3, further comprising:

a clock circuit connected to said controller for generating a time signal indicative of the current time of day; and wherein said door controller sets said predetermined interval dependant upon said time signal.

8. The automatic door receiver system as claimed in claim 7, wherein:

said door controller sets said predetermined interval for a shorter time during times of day expected to have a large rate of vehicle passage through the door relative to times of day expected to have a small rate of vehicle passage through the door.

9. The automatic door receiver system as claimed in claim 3, further comprising:

a lot full indicator connected to said receiver controller and for generating a lot full indication perceivable from a vehicle immediately exterior of the opening upon receipt of a lot full signal; and said receiver controller for incrementing a lot vehicle count upon each movement of the door from the closed position to the opened position upon receipt of a demodulated identity code corresponding to an authorized identity code, decrementing said lot vehicle count upon each movement of the door from the closed position to the opened position in response to detection of a vehicle immediately interior of the opening, supplying said lot full signal to said lot full indicator and inhibiting generation of said door open signal upon receipt of a demodulated identity code corresponding to an authorized identity code whenever said lot while count is greater than or equal to a predetermined lot vehicle capacity.

* * * * *